United States Patent [19]

Killer

[11] Patent Number: 4,482,139

[45] Date of Patent: Nov. 13, 1984

[54] TRANSPORT AND SEPARATING APPARATUS FOR FOLDED PRINTED MATTER

[75] Inventor: Viktor Killer, Greifensee, Switzerland

[73] Assignee: Daverio A.G., Zurich, Switzerland

[21] Appl. No.: 463,296

[22] Filed: Feb. 2, 1983

[30] Foreign Application Priority Data

Feb. 3, 1982 [CH] Switzerland ..... 657/82

[51] Int. Cl.[3] ..... B65H 39/00

[52] U.S. Cl. ..... 270/52; 198/418; 198/644

[58] Field of Search ..... 270/52–54, 270/57–58; 198/779, 426, 418, 649–650, 644

[56] References Cited

U.S. PATENT DOCUMENTS 3,630,513 12/1971 Davidson, Jr. ..... 270/53
4,280,690 7/1981 Hill ..... 270/58

FOREIGN PATENT DOCUMENTS 970681 7/1948 France ..... 270/52
6600484 9/1966 Netherlands ..... 270/52

*Primary Examiner*—E. H. Eickholt
*Attorney, Agent, or Firm*—Weiser & Stapler

[57] ABSTRACT

The apparatus has two generally parallel transport means in the form of chains guided within tracks. Double armed levers are attached to the chains which carry clamping rollers, whose surfaces are of elastically yielding material. Folded printed matter is supplied to the clamping rollers of both transport means in a shingled stream. Every two printed items are folded within each other but displaced laterally by a distance A. The clamping rollers grasp the edges of the printed items and transport them. After grasping the printed matter, the transport means diverge, whereby the printed items which are folded within each other are also automatically drawn apart.

3 Claims, 5 Drawing Figures

TRANSPORT AND SEPARATING APPARATUS FOR FOLDED PRINTED MATTER

The invention relates to apparatus according to the preamble of patent claim 1.

From Swiss Pat. No. 322,276 there is known a system for transporting folded newspapers, by means of which the folded newspapers which lie on top of each other in shingle like manner are grasped on one side at the unprinted edge by clamping rollers, are bent in wave shape and transported. The clamping rollers are attached to an endless chain which is guided within guidance tracks which are capable of extending in any desired directions, horizontally and vertically. This transport arrangement has a high transport capacity and has been successful in practice.

For some time it has been customary, for certain printed matter, to fold within each other in the folding apparatus of rotary machines two printed items at a time, the two printed items being laterally displaced from each other by about 25 to 60 mm, so that the edge of the inner one protrudes beyond that of the outer printed item.

From German Pat. No. 22417614 there is known an endless transport arrangement with two rows of circulating loop grippers. These grippers, which are guided in displacable manner upon transverse rods, grasp the printed items at the edge and lead these apart exactly transversely to the transport direction. During this separating process the shingled stream moves in a horizontal plane. This system is not optimal, particularly for thick items and high transport speeds.

It is an object of the present invention to provide an arrangement of the initially defined type which is such that the printed matter is not only transported, but that the printed items which are folded within each other in displaced manner are also simultaneously automatically drawn apart. This arrangement should also function optimally for thick printed items and high transport velocities.

This objective is achieved in accordance with the invention by an arrangement which corresponds to the characterizing portion of patent claim 1. Because, in each case, the free edges of two printed items folded within each other are grasped by the rollers and led apart, the printed items can be separated while being transported and can be further transported in two separate shingled streams.

Preferably the endless transport means, whose rollers grasp the edge of the outer one of the printed items which are folded within each other, moves about 1 to 10% faster then the other transport means. In this manner the printed items which are folded within each other can be optimally drawn apart.

Preferably the distance between the two transport means is adjustable. This makes it possible to adapt the apparatus to the size of the printed matter.

Figure 1:
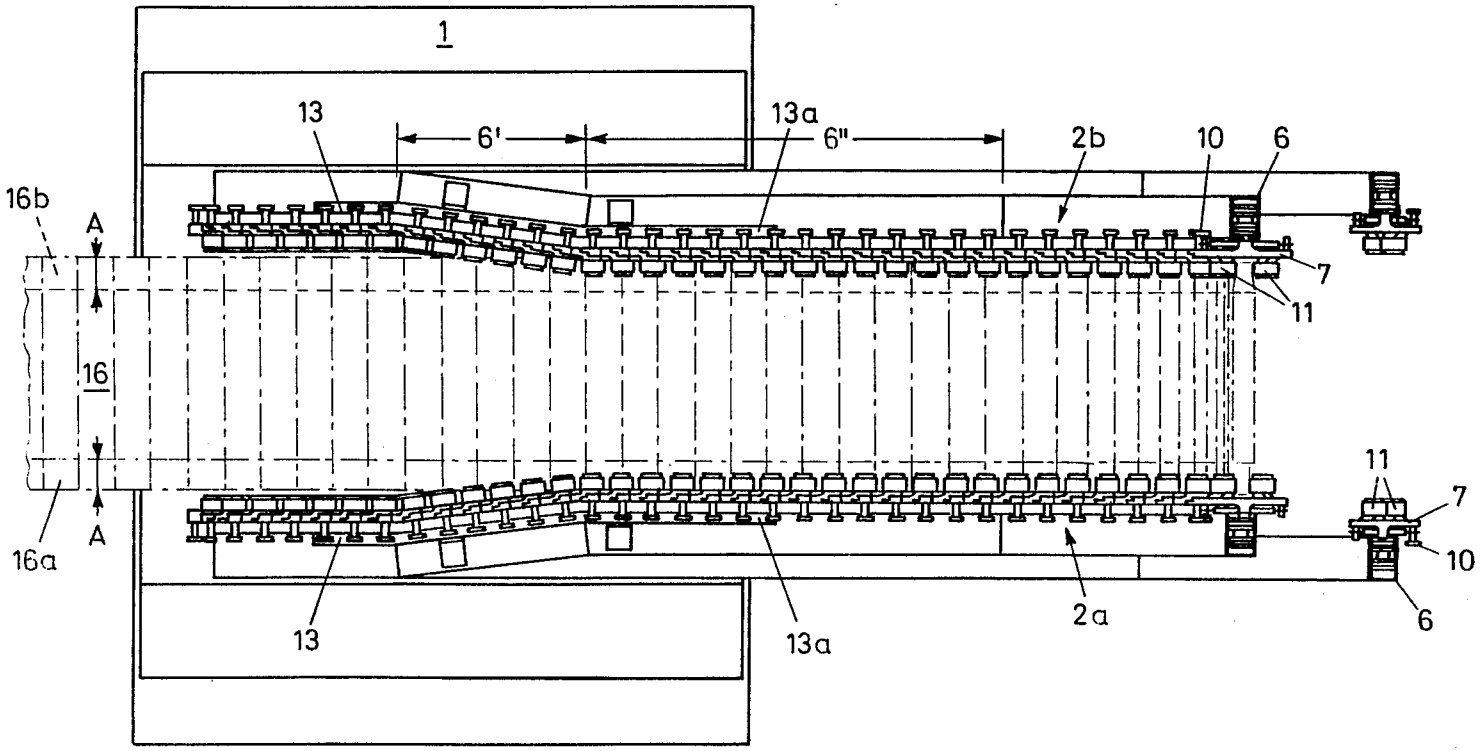
Figure 2:
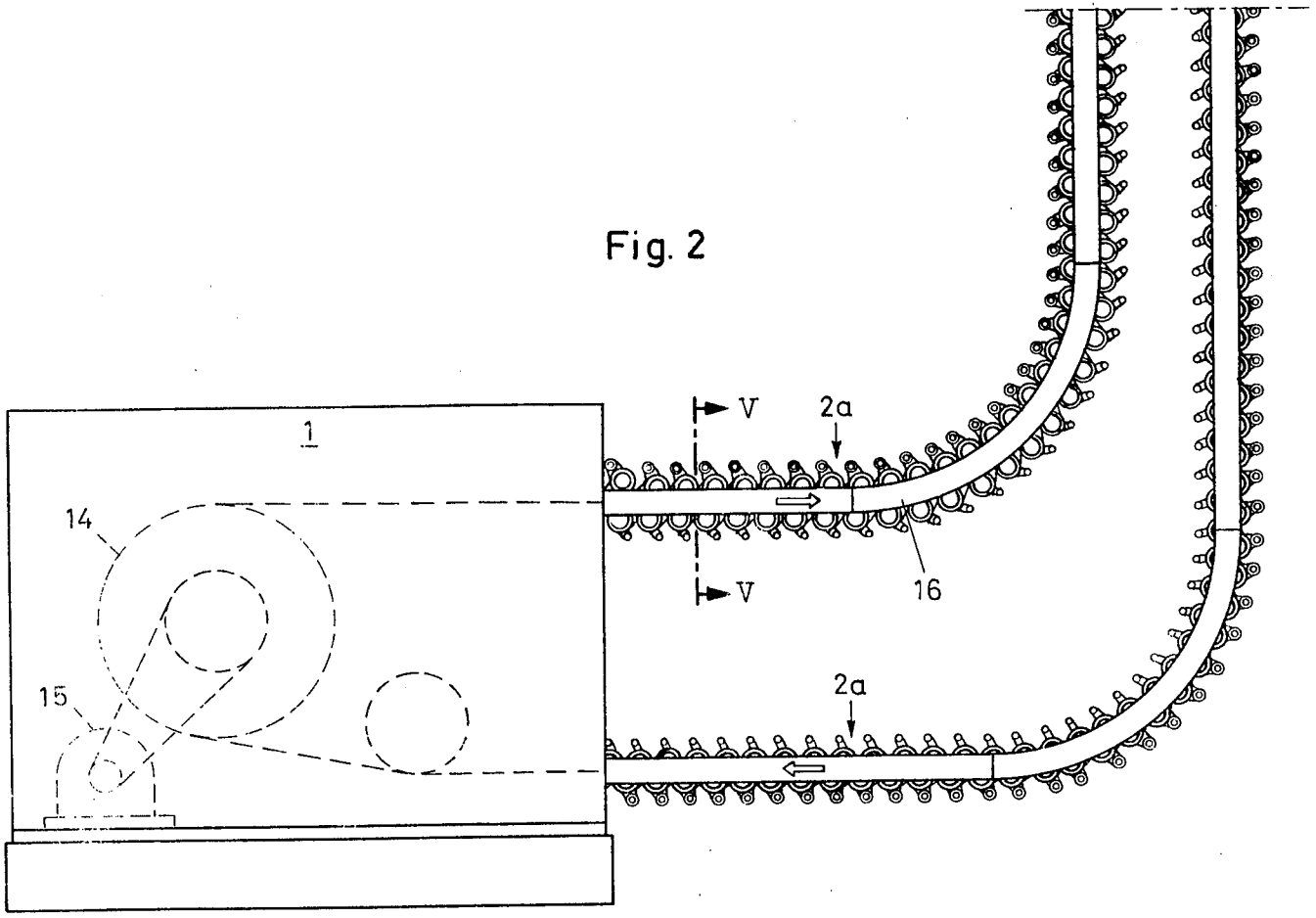
Figure 3:
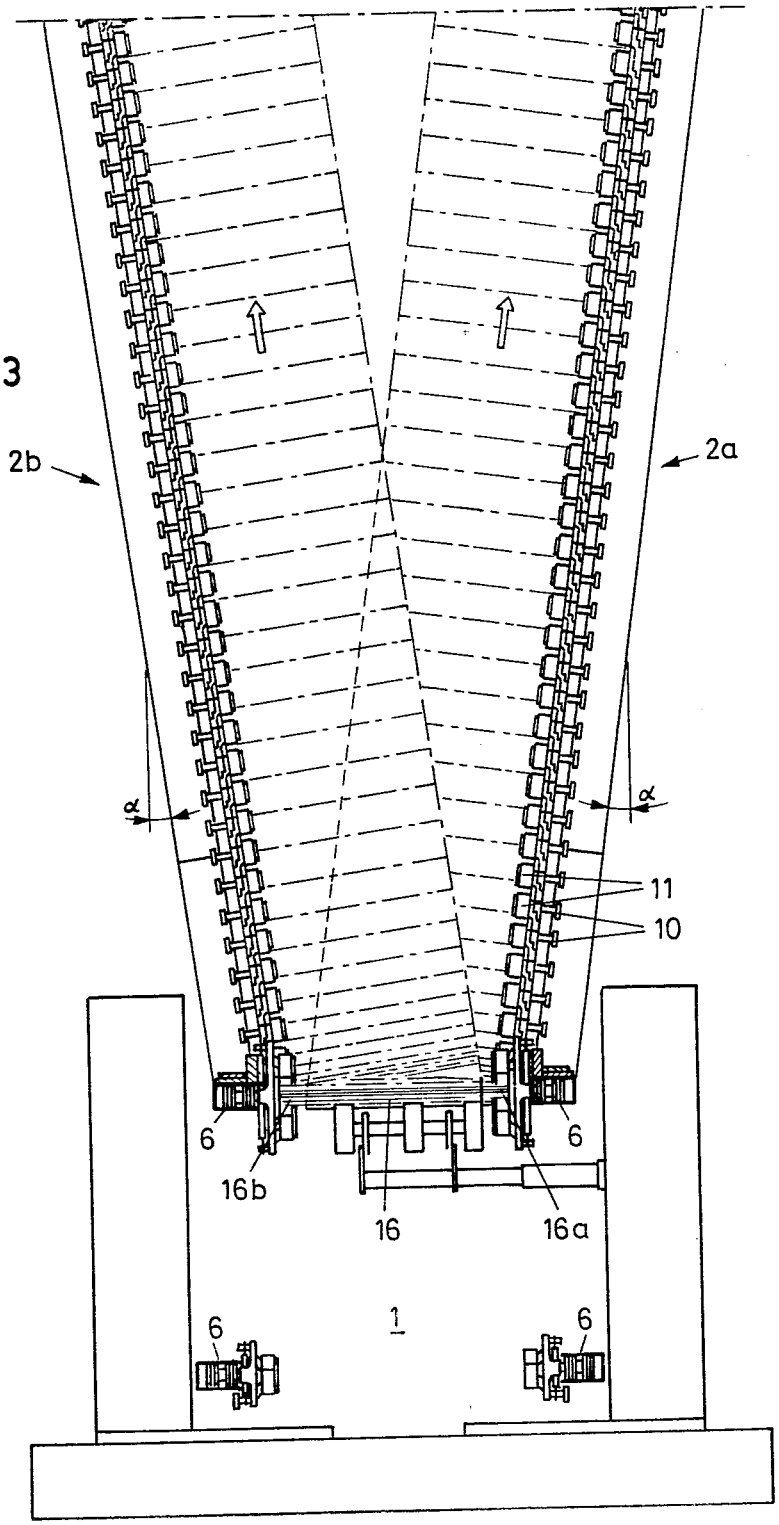
Figure 4:
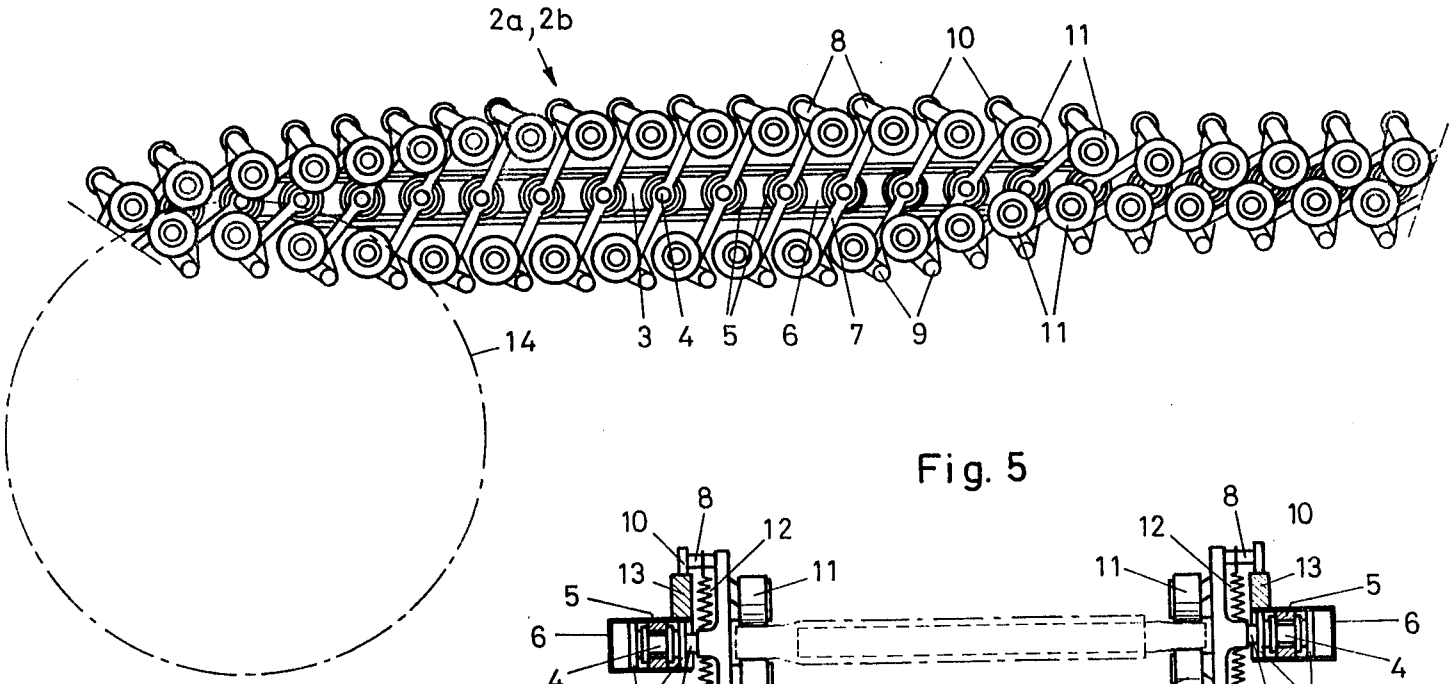
Figure 5:
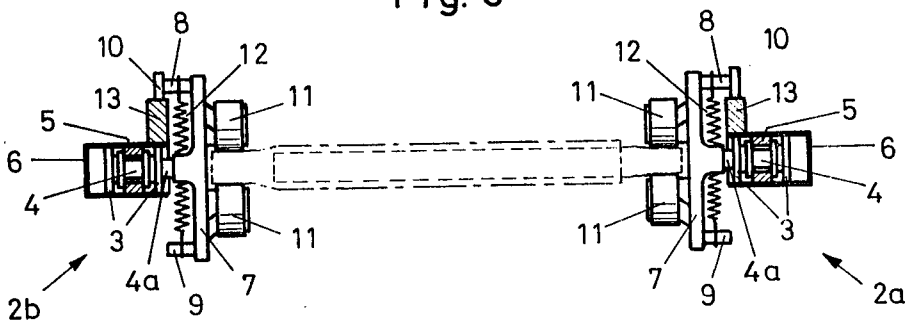

An illustrative embodiment of the apparatus embodying the invention is further described below, with reference to the drawings wherein:

FIG. 1 is a schematic illustration of a top view of the apparatus for transporting and separating folded printed matter, FIG. 2 is a side elavation view of the apparatus of FIG. 1, FIG. 3 is a view of the apparatus of FIG. 1 seen from the input end, FIG. 4 is a view of a portion of one of the two endless transport means in the region of introduction of the printed matter, and FIG. 5 is a cross-section along line V—V in FIG. 2.

In FIGS. 1 to 3 there is shown the receiving station 1 of the apparatus with a portion of the endless transport means 2*a*, 2*b*, in diagrammatic form. The construction of the endless transport means which are already known in themselves can be seen in FIGS. 4 and 5. The transport means 2*a*, and 2*b* include an endless chain with links 3, upon whose axles 4 rollers 5 are mounted. The chain runs within a guidance track 6 having a U-shaped cross-section, by whose internal walls the rollers 5 are guided. Each axle portion 4*a* extending out of the guidance track carries a double armed lever 7, to whose outer ends two outwardly extending pins 8, 9 are attached. Each pin 8 carries a small guidance roller 10. To each double armed lever 7 there are further attached two inwardly oriented clamping rollers 11, whose rolling surface is made of an elastically yielding material, e.g. an elastic foam. Each pin 8 is connected with the pin 9 of the adjoining lever 7 by a pretensioned traction spring 12. By means of these springs 12, the doubled armed levers 7 are so pivoted that, as is shown at the right hand end of FIG. 4, any one clamping roller 11 is caused to lie in the space between two adjoining clamping rollers 11. Should there be printed matter between the clamping rollers, this is firmly clamped between the rollers 11 and thereby transported.

At the input end for the printed matter to be transported and at the output end thereof, the clamping rollers 11 are lifted away from each other as is shown in the middle portion of FIG. 4. For that purpose, the guidance rollers 10 move along guidance tracks 13 shown in FIGS. 1 and 5, so that all the levers 7 are pivoted against the force of springs 12 and the clamping rollers 11 are caused to be separated from each other. At the input station 1, each transport means 2*a*, 2*b* moves about a respective turnabout wheel 14, each of which is driven by a separate motor 15.

The folded printed items 16 which arrive upon a conveyor belt and form a shingled stream, are supplied, e.g. from the folding apparatus of a rotary machine, in such manner that every two printed items are folded within each other, but are laterally displaced by a distance A. The inner one of the two printed items therefore projects with its edge 16*a* from the outer printed item, whereas upon the opposite side edge 16*b* is present which is formed only by the outer printed item. The guidance tracks 6 of the input portion of the transport means 2*a*, 2*b* have an inwardly inclined portion 6' within the input station 1. As a result, the lower and upper clamping rollers 11 which are displaced from each other in this region, can become positioned above and below the edges 16*a* and 16*b*, respectively. At the end 13*a* of the guidance tracks 13 the edges 16*a* and 16*b* are then grasped and firmly clamped by the clamping rollers 11.

After region 6', the guidance tracks 6 extend horizontally within a region 6" and are then bent toward the vertical by a 90° turn. In horizontal region 6" the guidance tracks are turned somewhat outwardly so that in the vertical region, as can be seen from FIG. 3, they extend inclined outwardly by an angle $\alpha$ of about 5° to 10°. This causes the printed items 16 which are folded within each other to be drawn apart. They then follow two parallel tracks to an output location which has not been illustrated. The two transport means 2*a*, 2*b*, are then returned to the input station 1 of the apparatus.

It has been found desirable to drive the transport means 2*b* which transports the outer ones of the two printed items folded within each other about 1 to 10% more rapidly than the transport means 2*a*. In this manner the printed items which are folded within each other can be drawn apart in optimal manner.

The two transport means 2*a*, 2*b* with their drive motors are completely independent of each other. They can therefore be displaced relative to each other, which makes the spacing of the transport means 2*a*, 2*b* adjustable and enables adaptation to printed items of difference sizes.

I claim:

1. Apparatus for transporting and separating folded printed items, which are supplied from a rotary machine on a conveyor in a shingled stream, and in which every two printed items are folded within each other but displaced laterally from each other, and in which the apparatus has as its grasping means rollers attached to an endless transport means guided within tracks, each roller bearing resiliently against at least one adjoining roller and grasping the printed items at their edge between the rollers and transporting them, characterized in that an endless transport means with rollers is positioned laterally on both sides of the shingled stream, the guidance tracks of both transport means being turned within a horizontal region shortly after grasping of the printed items by the rollers longitudinally by a predetermined angle, in such manner that the two transport means diverge in V configuration after being turned by about 90° into a vertical region and draw apart the printed items folded within each other.

2. The apparatus of claim 1 characterized in that the endless transport means whose rollers grasp the edge of the outer one of the two printed items folded within each other moves about 1 to 10% more rapidly than the other transport means.

3. Apparatus according to claim 1 characterized in that the spacing between the two transport means is adjustable.

* * * * *